US010562682B2

(12) United States Patent
Chen et al.

(10) Patent No.: US 10,562,682 B2
(45) Date of Patent: Feb. 18, 2020

(54) CLOSURE ASSEMBLY FOR A CONTAINER

(71) Applicant: Conopco, Inc., Englewood Cliffs, NJ (US)

(72) Inventors: Jun Chen, Shanghai (CN); Nurani Dharmaraj Krishnaprakash Iyer, Mumbai (IN); Peter Erich Pargen, Zell/Mosel (DE)

(73) Assignee: CONOPCO, INC., Englewood Cliffs, NJ (US)

( * ) Notice: Subject to any disclaimer, the term of this patent is extended or adjusted under 35 U.S.C. 154(b) by 23 days.

(21) Appl. No.: 15/558,580

(22) PCT Filed: Mar. 7, 2016

(86) PCT No.: PCT/EP2016/054778
§ 371 (c)(1),
(2) Date: Sep. 15, 2017

(87) PCT Pub. No.: WO2016/150685
PCT Pub. Date: Sep. 29, 2016

(65) Prior Publication Data

US 2018/0057224 A1 Mar. 1, 2018

(30) Foreign Application Priority Data

Mar. 20, 2015 (WO) ..... PCT/CN2015/074702
Apr. 29, 2015 (EP) ..... 15165625

(51) Int. Cl.
*B65D 47/00* (2006.01)
*B65D 47/28* (2006.01)
*B65D 43/02* (2006.01)

(52) U.S. Cl.
CPC ..... *B65D 47/286* (2013.01); *B65D 43/0204* (2013.01)

(58) Field of Classification Search
CPC ... B65D 47/286; B65D 43/0204; B65D 41/18
(Continued)

(56) References Cited

U.S. PATENT DOCUMENTS 1,713,043 A 5/1929 Fullerton
2,434,706 A * 1/1948 Malyszko ..... B65D 47/286 220/345.3

(Continued)

FOREIGN PATENT DOCUMENTS

CN 1183013 1/2005
CN 1832695 9/2006

(Continued)

OTHER PUBLICATIONS

Search Report and Written Opinion in EP15165625, dated Oct. 13, 2015.

(Continued)

*Primary Examiner* — Ernesto A Grano
(74) *Attorney, Agent, or Firm* — Foley & Lardner LLP

(57) ABSTRACT

The invention relates to a closure assembly (1) for a container (2) and a container thereof. The invention more particularly relates to a closure assembly which provides leak tight closure for liquid or viscous products and can be simply opened or closed by minimal effort and additionally can be inverted to stably rest on a horizontal surface to act as a tottle.

15 Claims, 3 Drawing Sheets

(58) Field of Classification Search
USPC ..... 220/254.9; 222/561
See application file for complete search history.

(56) References Cited

U.S. PATENT DOCUMENTS

| | | | | |
|---|---|---|---|---|
| 3,853,250 | A * | 12/1974 | Alpern | B65D 47/0866 222/517 |
| 4,505,400 | A | 3/1985 | Bennett | |
| 6,398,082 | B2 | 6/2002 | Clark et al. | |
| 6,439,442 | B1 * | 8/2002 | Markert | B65D 47/286 215/322 |
| 6,976,577 | B2 | 12/2005 | Devine | |
| 7,275,653 | B2 * | 10/2007 | Tedford, Jr. | B65D 47/286 220/254.9 |
| 7,455,191 | B2 * | 11/2008 | Bhavnani | A47J 41/0016 220/254.9 |
| 8,074,849 | B2 * | 12/2011 | Domoy | B65D 47/2006 222/556 |
| D669,306 | S * | 10/2012 | Barreto | D7/392.1 |
| 9,351,597 | B2 * | 5/2016 | Liu | B65D 43/02 |
| 9,914,566 | B2 | 3/2018 | Chevalier | |
| 10,112,749 | B2 * | 10/2018 | Iyer | B65D 47/286 |
| 2002/0027137 | A1 * | 3/2002 | Price | A47G 19/2272 220/23.87 |
| 2006/0278640 | A1 * | 12/2006 | Watts | B65D 47/286 220/212 |
| 2007/0246467 | A1 * | 10/2007 | Kneer | B65D 39/16 220/254.9 |
| 2009/0057324 | A1 * | 3/2009 | Wang Wu | B65D 47/249 220/711 |
| 2012/0312816 | A1 * | 12/2012 | Barreto | B65D 43/022 220/254.7 |
| 2014/0299600 | A1 * | 10/2014 | Chevalier | A45D 34/00 220/254.9 |
| 2018/0050847 | A1 * | 2/2018 | Herling | A47G 19/2272 |

FOREIGN PATENT DOCUMENTS

| | | |
|---|---|---|
| CN | 100579873 | 1/2010 |
| CN | 104024120 | 10/2012 |
| EP | 0196250 | 10/1986 |
| GB | 1094588 | 11/1965 |
| JP | 50146951 | 12/1975 |
| JP | 2111646 | 9/1990 |
| JP | 2005119709 | 5/2005 |
| JP | 2011111224 | 6/2011 |
| WO | WO2013061003 | 5/2013 |

OTHER PUBLICATIONS

Search Report and Written Opinion in PCTEP2016054778, dated May 9, 2016.

* cited by examiner

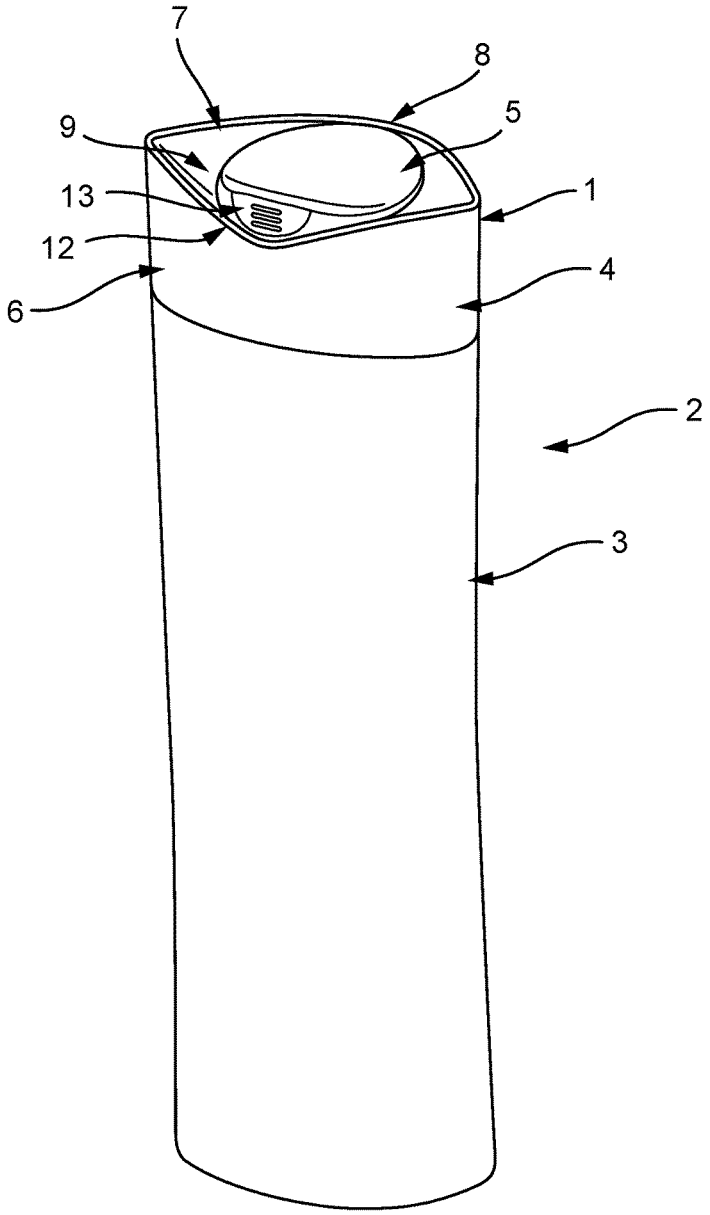
Figure 1: Perspective view of the container comprising the closure assembly mounted on the container body

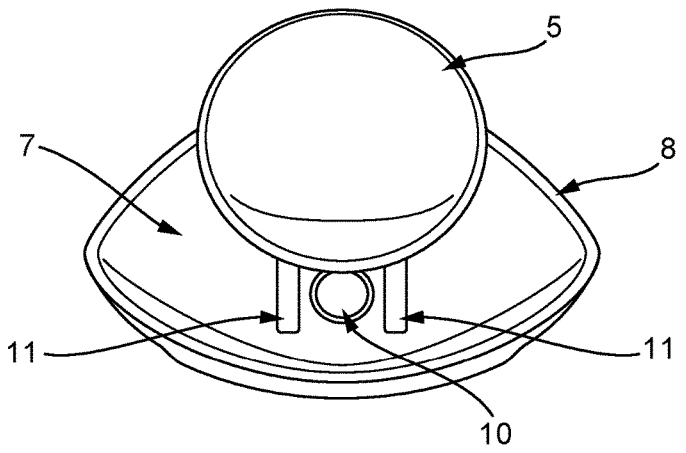
Figure 2: Top view of the closure assembly in the open position
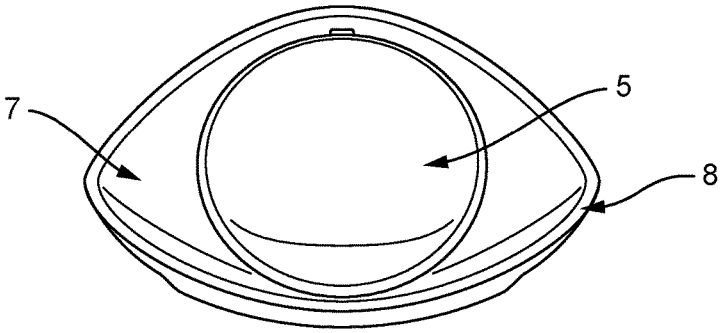
Figure 3: Top view of the closure assembly in the closed position

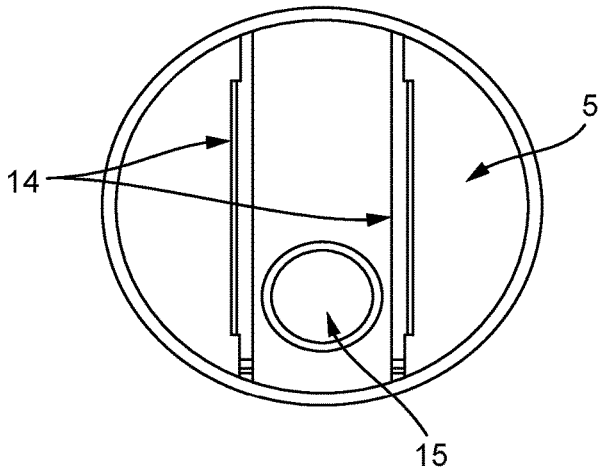
Figure 4: Bottom view of the disc shaped closure
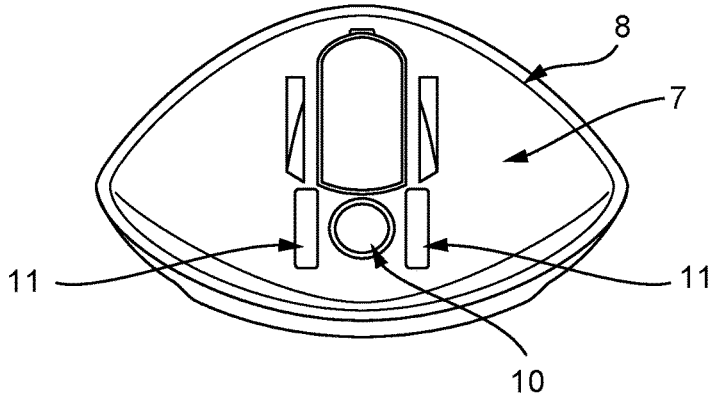
Figure 5: Top view of the container head with the disc shaped closure removed

CLOSURE ASSEMBLY FOR A CONTAINER

FIELD OF THE INVENTION

The invention relates to a closure assembly for a container and a container thereof. The invention more particularly relates to a closure assembly which provides leak tight closure for liquid or viscous products and can be simply opened or closed by minimal effort and additionally can be inverted to stably rest on a horizontal surface to act as a tottle.

BACKGROUND OF THE INVENTION

Containers come in various sizes and shapes. Containers for products for use in homes e.g. those for home care, personal care and foods come in relatively small sizes e.g. from a few milliliters to a few liters. Products in these categories that are used to store and dispense liquid or viscous products e.g. those in watery, emulsion, lotion, gel, cream or semi solid forms require dispensing ports that are designed with closures that have to be leaktight when in the closed positions and dispense freely when in the open position. Further, the closures have to be relatively easy to operate such that the user does not have to use undue pressure, while at the same time, the closure in the closed position does not cause leakage of the material from the container.

Several types of closures are known and have been used for dispensing products from such containers. Well known closures are of the threaded screw, flip-top, friction fit, snap-fit, or gated closure types among several others. The present invention relates to closures for bottles that dispense products for home or personal care especially personal care e.g. in dispensing liquids and viscous products like shampoos, conditioners, personal wash liquids and lotions. The bottles may also be used for storage and dispensing of cleansing products for homes and furnishings. The closure of the present invention is of the slider type where a disc shaped element reversibly slides on top of the dispensing port of the container, thereby enabling opening and closing of the dispensing port. Such a type of closure has been disclosed in the past. GB1094588A discloses a container closure which comprises a plastics part spherical valve member having an integral pin press-fitted into and slidable along a radial slot of a correspondingly shaped part-spherical depression in a boss on the top of a container. The valve may be slidden to a position generally parallel to the container top, so that its pin is parallel to the main axis of the container, when it closes the dispensing opening. The valve member acts as a pouring spout. The container top may be of tin, plastics or waxed cardboard.

There is a need in the art to provide for a closure assembly that is easy to operate with a simple horizontal push of the thumb or a finger which ensures leak tight opening and closing of the container dispensing port while the top of the container closure assembly is configured that it can be inverted to be stably placed on a table top to act like a tottle.

A tottle is a container, generally elongated that can be placed stably on its bottom surface on a horizontal plane like any normal bottle. A tottle, additionally, is so configured that the bottle can be inverted and placed stably on its top surface on a horizontal plane. This is especially useful when the contents of the container are very less and it takes a long time for the user to invert and shake the container so as to dispense the remaining contents, which is especially difficult when the contents are very viscous. A tottle, in such a circumstance will be placed on its head so that the contents are collected towards the dispensing top end of the container, so that the user can dispense the contents without too much effort.

None of the prior known or published container closure systems including GB1094588 disclose all of the above desired advantages where the container can be used as a bottle or a tottle, has a closure system that is easy to push open and close with a simple horizontal push of the thumb and provides leak proof closing of the outlet port of the container even after continued use of the system for a long time.

It is thus an object of the present invention to provide for a closure system for a container that is easy for the consumer to open and close with a simple horizontal movement using the thumb or a finger.

It is another object of the present invention to provide for a closure system for a container that is easy for the consumer to open and close with a simple horizontal movement using the thumb or a finger while being leakproof every time the closure is closed after use.

It is yet another object of the present invention to provide for a closure system for a container that is easy for the consumer is open and close, is leakproof on closing and can additionally be used as a tottle.

SUMMARY OF THE INVENTION

The first aspect of the present invention relates to a closure assembly for a container adapted to be mounted on a container body comprising (a) a container head; and (b) a disc shaped closure; wherein the container head has upwardly extending walls and a top surface and an edge therebetween;

said top surface comprising a curved depressed portion comprising an outlet port in fluid communication with said container body; and the upper surface of said depressed portion is provided with a set of parallel tracks;

said edge comprising a v-shaped portion extending downwardly into a portion of said wall;

the disc shaped closure comprising a raised portion at a circumferential part thereof; and provided at its bottom surface with a set of parallel railings adapted to be engaged in a sliding configuration with said set of parallel tracks; the disc shaped closure is provided with a resilient disc at its bottom surface adapted to slide over said outlet port;

such that the disc shaped closure can be slid over the top surface of the container head through the sliding engagement of the parallel tracks with the parallel railings between an open position and a closed position.

Another aspect of the present invention relates to a container comprising a container body and a closure assembly of the first aspect adapted to be releasably engagable to each.

The invention will now be illustrated in relation to non-limiting exemplary embodiments that are intended to enable one to visualize the various specific embodiments being described and is not intended to limit the invention in any way.

BRIEF DESCRIPTION OF THE FIGURES

FIG. 1 is a perspective view of an embodiment of the container comprising the closure assembly mounted on the container body FIG. 2 is the top view of the embodiment of the closure assembly in the open position FIG. 3 is the top view of the embodiment of the closure assembly in the closed position FIG. 4 is the bottom view of the embodiment of the disc shaped closure FIG. 5 is the top view of the embodiment of the container head with the disc shaped closure removed

DETAILED DESCRIPTION OF THE INVENTION

These and other aspects, features and advantages will become apparent to those of ordinary skill in the art from a reading of the following detailed description and the appended claims. For the avoidance of doubt, any feature of one aspect of the present invention may be utilised in any other aspect of the invention. The word "comprising" is intended to mean "including" but not necessarily "consisting of" or "composed of." In other words, the listed steps or options need not be exhaustive. It is noted that the embodiments illustrated and the examples given in the description below are intended to clarify the invention and are not intended to limit the invention to those embodiments and examples per se.

Except in the operating and comparative examples, or where otherwise explicitly indicated, all numbers in this description indicating amounts of material or conditions of a method, physical properties of materials and/or use are to be understood as modified by the word "about". Unless specified otherwise, numerical ranges expressed in the format "from x to y" are understood to include x and y. When for a specific feature multiple preferred ranges are described in the format "from x to y", it is understood that all ranges combining the different endpoints are also contemplated.

The present invention relates to a closure assembly for a container, adapted to be mounted on a container body. The container is preferably elongate. The container body is also preferably elongate meaning that the longitudinal dimension of the container body is longer than the lateral dimension. The cross-section of the container body could be of any suitable shape like circular, oval, polygonal or any other arcuate shape. It could also be designed to have a cross section that is different along the length of the container body. The container body is preferably made of polymeric material, more preferably of a rigid plastic which may be selected from polypropylene (PP), polyethylene terephthalate (PET) or high density polyethylene (HDPE), and is most preferably HDPE.

The closure assembly comprises a container head and a disc shaped closure. The container head has upwardly extending walls and a top surface and an edge therebetween.

A closure assembly, thus, has an edge on the container head which is defined by the intersecting line between the upwardly extending walls and the container top surface. The presence of the v-shaped portion as part of the edge to facilitate convenient movement of the disc shaped closure makes it difficult to configure the container to also act like a tottle. This has been overcome by ensuring that at least 50%, preferably at least 70% of the perimeter of the edge is at a substantially horizontal level. This aspect along with the others described above ensures that not is the container closure easy to open and close while ensuring leak tightness, the container is also capable of being used as a tottle. It is preferred that the vertical distance as defined in the v-shaped portion is less than 50% of the maximum height of the upwardly extending wall of the container head. It is preferred that the v-shaped portion constitutes less than 50% of the perimeter of the edge, preferably less than 40%. It is further particularly preferred that the v-shape has an angle between 90 and 150 degrees.

The container head therefore has an inverted cup shape. The container head preferably has a cross-section at its lower end that is adapted to engage with the top end of the container body and more preferably the cross-section at its lower end is the same as that of the cross section of the top end of container body. The container head has a top surface which comprises a curved depressed portion comprising an outlet port in fluid communication with container body. The outlet port is preferably at the lowermost point of the depressed portion. The outlet port could be of any preferred shape, preferred ones being circular, oval, square or rectangular, most preferred shape being circular. The upper surface of the container head in its depressed portion is provided with a set of parallel tracks. The edge of the container top defined by the border line between its upwardly extending walls and its top surface comprises a v-shaped portion extending downwardly into a portion of the wall of the container top. The container head is preferably polymeric, more preferably made of rigid plastic and may be chosen from one of PP or HDPE and is most preferably made of PP.

The disc shaped closure comprising a raised portion at one of its circumferential ends. The raised portion is preferably positioned in line with and posterior to the v-shaped portion of the container top. Thus, the raised portion is positioned just posterior to the v-shaped portion, and on the same side of the closure assembly, such that the disc shaped closure can be conveniently slid using a thumb in a horizontal direction through the v-shaped portion of the container head. The advantage of such a configuration as compared to past sliding assembly closures is that the elements of the closure assembly defined above enable a simple movement of the disc in substantially the horizontal direction with the thumb which makes the opening and closing very convenient for the user. As compared to this, closure assemblies disclosed and used in the past have to be pushed in a direction which is initially horizontal and as the disc moves the thumb has to be pushing in a direction between partly horizontal and partly vertical which leaves the consumer having to exert more pressure than is necessary as he is not sure in which direction the pressure is to be exerted. Additionally, the closure assembly in the present invention is so configured that the thickness of the disc shaped closure at the raised portion is preferably substantially the same as the vertical distance from the bottom of the v-shaped portion to the above defined substantially horizontal level of the edge, such that the container can be inverted and stably placed on a horizontal surface to act as a tottle. Thus, the raised portion on the disc shaped closure is inventively configured in the present invention to not only enable easy opening and closing of the closure with a simple horizontal thrust, but also in combination with the preferable aspect of at least 50% of the edge being on a horizontal place provide further stability to the container to be inverted and placed on a horizontal surface to act as a tottle.

The disc shaped closure is provided at its bottom surface with a set of parallel railings. The parallel tracks on the top of the container head and the parallel railings at the bottom of the disc shaped closure are adapted to be interlocked and engaged in a sliding configuration such that the disc shaped closure can be moved back and forth on top of the container head. The disc shaped closure is preferably polymeric, more preferably made of PP, HDPE or low density polyethylene (LDPE) and most preferably made of PP. The disc shaped closure could be of any possible shape preferably circular or oval, more preferably oval. The disc shaped closure is provided with a resilient disc at its bottom surface. The resilient disc is adapted to slide over on the top surface of the container head and is so positioned that the resilient disc covers the outlet port when the disc shaped closure is moved into a closed position. The resilient disc has a shape which corresponds to the shape of the outlet port and is slightly bigger in the radial dimension so as to completely cover the outlet port to form a leak-tight closure. The resilient disc is preferably made of thermoplastic elastomer (TPE) or thermoplastic resin (TPR) or silicone material more preferably of TPE material. Such a resilient disc in a slider closure assembly of this sort has not been disclosed before. This aspect ensures that the closure is not only easy to open and close but also leak tightness is ensured. It is preferred that the outlet port on the container body is substantially on the same horizontal level as the bottom of the v-shaped portion.

A particularly preferred aspect of the present invention provides for both the outlet port on the container head and the resilient disc on the bottom surface of the disc shaped closure to be substantially circular.

A container of the second aspect of the present invention comprises the container body and the closure assembly as hereinabove defined. The container body and the closure assembly are preferably adapted to be releasably engagable to each. Such a releasable engagement is preferably a snap-fit connection. The snap fit connection may be embodied using a bead and snap assembly between the next of the neck of the container and the lower surface of the container head.

The container and the closure assembly disclosed in the present invention are suitable for dispensing fluid products for use in home and personal care. Preferred products which may be dispensed include shampoos, conditioners, personal wash liquids, detergents, gels, lotions and other liquid solutions. It is preferred that the container and the closure assembly is used to dispense fluid products having a viscosity in the range of 3000 to 25,000 cps at 25° C.

DETAILED DESCRIPTION OF THE FIGURES

FIG. 1 is a perspective view of an embodiment of the container comprising the closure assembly mounted on the container body Referring to FIG. 1, the container (2) comprises a closure assembly (1) mounted on a container body (3). The closure assembly (1) comprising a container head (4) and a disc shaped closure (5). As can be seen in FIG. 1, the container head (4) has upwardly extending walls (6) and a top surface (7). The intersection of the upwardly extending walls and the top surface defines an edge (8). The top surface comprises a curved depressed portion (9). One portion of the edge extends downwardly into a portion of the wall to define a v-shaped portion (12). The disc shaped closure comprises a raised portion (13) at a circumferential part.

FIG. 2 is the top view of the embodiment of the closure assembly in the open position.

Referring to FIG. 2, the top surface of the container head is shown with the disc shaped closure (5) in the open position. The top surface of the container head comprises an outlet port (10) which is in fluid communication with the container body. The top surface (7) of the container head is provided with a set of parallel tracks (11).

FIG. 3 is the top view of the embodiment of the closure assembly in the closed position.

Referring to FIG. 3, the top surface of the container head (7) and the edge (8) are shown as well as the disc shaped closure (5) in the closed position.

FIG. 4 is the bottom view of the embodiment of the disc shaped closure.

Referring to FIG. 4, the disc shaped closure is provided at its bottom surface with a set of parallel railings (14) adapted to be engaged in a sliding configuration with the set of parallel tracks (11) shown in FIG. 2. The disc shaped closure is provided also on the bottom surface with a resilient disc (15) which is adapted to slide over the outlet port (10) shown in FIG. 2.

FIG. 5 is the top view of the embodiment of the container head with the disc shaped closure removed.

Referring to FIG. 5, the top surface of the container head is shown without the disc shaped closure (5) which comprises an outlet port (10) which is in fluid communication with the container body. The top surface (7) of the container head is provided with a set of parallel tracks (11). The upper surface of the container head is circumscribed by the edge (8).

When in use, to open the container, the raised portion (13) is pushed back in the horizontal direction with a thumb or a finger. The disc shaped closure slides back on the top surface (7) due to the sliding engagement of the parallel railings and the parallel tracks. The resilient disc (15) on the bottom surface of the disc shaped closure slides away from the top of the outlet port (10) thereby exposing the outlet port to the open thereby enabling easy and convenient dispensing of the contents of the container by simply overturning it. To close the container, the disc shaped closure is pulled back in the horizontal direction to enable the resilient disc to sit flush against the outlet port to provide the necessary leak proof closure.

When the contents of the container are nearly exhausted, the container may be inverted and stably placed on its head to act as a tottle, so as to enable quick and convenient dispensing of even minimal amounts of contents remaining in the container without too much effort on the part of the consumer.

The invention thus provides for a closure system for a container that is easy for the consumer is open and close, is leakproof on closing and can additionally be used as a tottle.

The invention claimed is:

1. A closure assembly for a container adapted to be mounted on a container body comprising:

(a) a container head; and (b) a disc shaped closure; wherein the container head has upwardly extending walls and a top surface and an edge there between;

said top surface comprising a curved depressed portion comprising an outlet port in fluid communication with said container body; and the upper surface of said depressed portion is provided with a set of parallel tracks;

said edge comprising a v-shaped portion extending downwardly into a portion of said upwardly extending walls;

the disc shaped closure comprising a raised portion at a circumferential part thereof; and provided at its bottom surface with a set of parallel railings adapted to be engaged in a sliding configuration with said set of parallel tracks; the disc shaped closure is provided with a resilient disc at its bottom surface adapted to slide over said outlet port;

such that the disc shaped closure can be slid over the top surface of the container head through the sliding engagement of the parallel tracks with the parallel railings between an open position and a closed position.

2. The closure assembly as claimed in claim 1, wherein said raised portion is positioned just posterior to the v-shaped portion, and on the same side of the closure assembly, such that the disc shaped closure can be conveniently slid using a thumb in a horizontal direction through the v-shaped portion of the container head.

3. The closure assembly as claimed in claim 1, wherein at least 50% of the perimeter of the edge is at a substantially horizontal level.

4. The closure assembly as claimed in claim 3, wherein a thickness of the disc shaped closure at the raised portion is substantially the same as a vertical distance from a bottom of the v-shaped portion to said substantially horizontal level of the edge, such that the container can be inverted and stably placed on a horizontal surface to act as a tottle.

5. The closure assembly as claimed in claim 4, wherein said vertical distance is less than 50% of a maximum height of the upwardly extending wall of the container head.

6. The closure assembly as claimed in claim 1, wherein the v-shaped portion constitutes less than 50% of the perimeter of the edge.

7. The closure assembly as claimed in claim 1, wherein the outlet port is substantially on the same horizontal level as a bottom of the v-shaped portion.

8. The closure assembly as claimed in claim 1, wherein both the outlet port and the resilient disc are substantially circular.

9. The closure assembly as claimed in claim 1, wherein a v-shape of the v-shaped portion has an angle between 90 and 150 degrees.

10. The closure assembly as claimed in claim 1, wherein the container head is made of a rigid plastic selected from the group consisting of PP or HDPE.

11. The closure assembly as claimed in claim 1, wherein the disc shaped closure is made of a rigid plastic selected from the group consisting of PP, HDPE, or LDPE.

12. The closure assembly as claimed in claim 1, wherein the resilient disc is made of a material selected from the group consisting of TPE, TPR, or Silicone.

13. A container comprising a container body and a closure assembly as claimed in claim 1 adapted to be releasably engagble to each.

14. The container as claimed in claim 13, wherein the container body and the closure assembly are capable of releasable engagement using a snap-fit connection.

15. The container as claimed in claim 14, wherein said snap-fit connection is embodied using a bead and snap assembly between a neck of the container and a lower surface of the container head.

* * * * *